US006367976B1

(12) United States Patent
Bannister

(10) Patent No.: US 6,367,976 B1
(45) Date of Patent: Apr. 9, 2002

(54) MULTI-GUSSET FOR PINCH CLOSURE BAG

(75) Inventor: Roger Bannister, Crossett, AR (US)

(73) Assignee: Bemis Company, Inc., Minneapolis, MN (US)

( * ) Notice: Subject to any disclaimer, the term of this patent is extended or adjusted under 35 U.S.C. 154(b) by 0 days.

(21) Appl. No.: 09/590,623

(22) Filed: Jun. 8, 2000

(51) Int. Cl.[7] ..... B65D 33/16
(52) U.S. Cl. ..... 383/85; 383/109; 383/120
(58) Field of Search ..... 383/85, 109, 120, 383/123

(56) References Cited

U.S. PATENT DOCUMENTS

| | | | | | |
|---|---|---|---|---|---|
| 2,092,602 | A | | 9/1937 | Finn et al. | |
| 2,234,065 | A | * | 3/1941 | Vogt | 383/120 X |
| 2,307,902 | A | * | 1/1943 | Vogt et al. | 383/120 X |
| 3,023,947 | A | | 3/1962 | McDuffie | |
| 3,107,989 | A | * | 10/1963 | Fesco | 383/120 X |
| 3,197,118 | A | | 7/1965 | Meyerhoefer | |
| 3,508,701 | A | | 4/1970 | Saito et al. | |
| 3,650,460 | A | * | 3/1972 | Lokey | 383/109 |
| RE28,317 | E | * | 1/1975 | Goodrich | 383/85 |
| RE28,318 | E | * | 1/1975 | Goodrich | 383/85 |
| 3,955,749 | A | | 5/1976 | Turkenkopf | |
| 4,008,850 | A | * | 2/1977 | Goodrich | 383/109 X |
| 4,069,964 | A | | 1/1978 | Willet et al. | |
| 4,176,746 | A | | 12/1979 | Kooi | |
| 4,353,770 | A | * | 10/1982 | Kuckhermann | 383/109 X |
| 4,480,752 | A | | 11/1984 | Jacobs | |
| 5,326,576 | A | | 7/1994 | Zuege | |
| 5,460,839 | A | | 10/1995 | Archibald | |

FOREIGN PATENT DOCUMENTS

| | | | | |
|---|---|---|---|---|
| DE | 43 03 341 A1 | * | 8/1993 | 383/120 |
| FR | 1191611 | * | 10/1959 | 383/120 |

* cited by examiner

*Primary Examiner*—Jes F. Pascua
(74) *Attorney, Agent, or Firm*—Lee, Mann, Smith, McWilliams, Sweeney & Ohlson

(57) ABSTRACT

A multiple ply freight shipping bag having multiple side gussets. The bag being of the type having pinch closeable upper and lower ends. The side gussets and the bag plies all being stepped in incremental distances to form an elongated sealable stepping pattern for efficient closure of the bag to prevent outward sifting or channeling of products filling the bag. The upper and lower corners of the gusset walls are spot bonded together to maintain a locked position, hold ply alignment, and achieve increased bag strength during and after filling, and wherein the gussets are freely expandable therebetween from the bottom of the bag to the top.

19 Claims, 9 Drawing Sheets

MULTI-GUSSET FOR PINCH CLOSURE BAG

FIELD OF THE INVENTION

The invention is directed to gusseted large pinch-closure type multi-wall bags requiring side gussets from 5½–6" and larger.

BACKGROUND OF THE INVENTION

Gusseted bags, having top and bottom pinch closeable ends, are typically made in a multi-wall construction having a plurality of paper plies formed as a tube and laterally offset to provide seams for bonding. The top and bottom ends are usually stepped to provide opposing adhesive "laddered" bonding surfaces. These bags are generally called freight shipping bags in the industry.

In regard to such bags, there has begun a market demand for large side gussets of 5½–6" and greater. It is recognized that bags having single gusset sizes of 5½" or less work extremely well for small bags, such as for coffee, popcorn, vacuum cleaners, etc., because they are not highly load-stressed and may be manufactured on standard bag formers and filled on known bag spouting machinery.

The needs for larger gusset pinch closeable bags involve manufacturers who fill and ship the bags with higher bulk density products and that require greater bag volumes and pallet stackability, thus demanding a larger package. Such bulk products include pet foods, granulated food materials, flake-form materials, powdered and granular chemicals, agricultural products, such as potting soil bark, mulch, and the like. Accordingly, bag customers are requiring a wider range of capacity for a range of bulk densities. It is a goal in the industry to replace other bags that are limited in their capability for handling greater weights and volumes.

The industry has also found it beneficial to utilize large gusset bags in order to eliminate overhang when a shipment of bags is palletized.

The freight shipping packing and handling industries have found multi-wall bags with pinch closeable ends widely acceptable because of their relative ease in sealing and compatibility with well known bag closure equipment.

As the industry has sought to increase the size of gussetted pinch closeable bags, two major factors have arisen that compound the problem in producing the larger or wider side gussets required. As would be understood to those skilled in the art, the larger the gusset becomes, the more free board is needed to close the bag at the open end where the filling spout introduces the product. This means that extra paper is needed to close the top of the bag with paper covering the product so the bag has to be made bigger to accommodate this closure. The larger the gusset becomes the deeper the gusset ribs extend into the gusset of the end tuck and more room is required because these large ribs are difficult to push outwardly when the bag is being filled. This can cause irregular bag expansion that might lead to tearing and ripping. Heretofore, the multi-wall bag industry has not successfully developed or accepted large gusseted pinch closeable bags. Alternate ways have been attempted, such as by using other styles of bags. In great measure, larger gussets, i.e. those that would be generally about 6" or more in width, are difficult to make in single standard fold gussets. Large percentages of the bags manufactured must be discarded as inferior. The bag-making production lines using the larger gussets also have to be run at slower speeds than non-gusseted pinch closeable bag line speeds. As the industry has experienced, urging these large gussets to form in the tuber, due to the bulkiness in size, creates difficulty in handling and machining during the bag making process. The standard guideline in the multi-wall freight shipping bag has been to not specify gussets that are over 5½" wide. While certain manufacturers occasionally have provided these larger gussets, there is an inherent weakness at the gussets in large bags.

Antecedent to the present invention, bag manufacturers have not produced multiple gusseted pinch closeable bags. Instead, the industry has chosen to focus its effort in producing small-sized pinch bags having a standard single gusset, such as used for popcorn bags, small coffee bags, microwaveable bags, vacuum cleaner bags, and the like. Accordingly, smaller bags have become the norm with respect to utilizing side or lateral gussets. This is because the large gusseted bags have been found to require more timely machinery set-up for the tuber, former, and flattener, plus the impractical end result that they develop a higher waste at a lower production rate. When large gusset bags have been made in this fashion, the bag manufacturer simply accepts the inherent inefficiency and loss to meet an order of a customer.

Previous attempts at pinch closeable bags having gussets 6" and over also have had several other problems. For example, when considering a standard 17" by 33" by 8" bag, wherein the 8" is the gusset and bag width dimension, the gussets are formed in the bag sides lengthwise of the bag creating two gusset walls having a v-shape arrangement. Thus, the gusset is indented 4" deep on either side of the bag. When the bag lies empty ready to be filled, there are two 4" tucks at either side wall for a total of 8", thus leaving 9" between the inner folds of the v-shapes for a 17" wide bag. The room for spouting, filling and forming is thus lessened by 8" compared to a non-gussetted construction. It has been found that single large gussets of this type have difficulty in being outwardly expanded during the filling process because all of the gusset is facing inwardly and the product mass has to push the gusset in the outward direction. The inherent weakness in forcing paper plies outwardly and at localized pressure zones can lead to bag rupture. There is a particular inherent weakness at the inside apex area of the v-shapes at the "manufactured end" (pre-sealed) of the bag. This can result in tearing and upward fracturing of the bag. The large gusset is difficult to fill out and square properly. The resulting gussets of a filled bag are often a little bit less than the intended bag width of 7 or 8" because the product in the bag does not fully push out the v-shaped gusset. This reduction in bag depth can also affect the presentation of advertising or printing on the bag sides. As would also be clear, because of this inability to shape or "square out," the filled bag may actually offer a diminished volume capacity inside the bag, which otherwise could be filled with the product.

Therefore, the major goals of the invention are (1) to provide more lateral or inboard room between gussets for forming, filling and spouting; (2) to create easier gusset-shaping during the filling step which allows the gussets to fill outwardly with less localized stress and less product pressure that would otherwise cause rupture in the previously known bags; (3) in providing larger gusseted (deeper) pinch-closeable bags, while maintaining sidewall strength, and (4) allowing the large gussets to be configured in a way so that the filled bags can subsequently be evenly stacked on a pallet without pallet overhang.

SUMMARY OF THE INVENTION

The present invention provides a multiple gusset for large freight shipping bags of the pinch closeable style wherein the manufactured end is pinch closed and the opposite open end is later sealed by the customer after filling the bag. The invention includes a unique step pattern and folded construction that when seal closed, satisfies industry wide drop testing strength, machine-ability, moisture barrier requirements, and seal closeability on standard pinch closure equipment. The invention may be summarized as providing a multiple gusset bag of greater than 5½–6" depth utilizing an improved seal-closeable stepping pattern, upper and lower end gusset bonds, and a maximized space between inward folds of the gussets to satisfy fill spouting requirements.

Standard pinch closeable three-ply bags with bag widths from about 14–20" have stepped multi-paper plies with a step pattern length about of 2¼" or less. For an equivalently sized bag, the present invention provides for a stepping pattern length of 2⅜–2½" having steps between adjacent ply edges of from 1/16" up to about 5/16", which in a preferred embodiment offers a double gusset in a three-ply paper bag. This creates 18 layers of ply thickness at the folded gusset, which when folded to form the pinch closure can create a thickness of over 30 plies at the pinch closed end. Another popular bag size is made of two plies having double-gussets creating a thickness of 12 plies at the gussets.

The inventive multi-gusset bag secures the ends of the gussets in a bonded or tacked arrangement, which does not separate during spouting, but yet allows the gusset portions for the full length of the bag therebetween to expand outwardly during filling.

On each side of the multi-wall bag, the gussets unfold outwardly taking a rectangular shape forming the squared sides of the bag. The multiple gussets extend from end-to-end, i.e., from the manufactured closed end to the upper open end for receipt of the fill spouting. Both ends of the pinch style bag are folded through the gussets. The invention allows the option of making a flush cut for a top sewn closure or otherwise creating a pinch closure at the open end. Space between gusset infolds is maximized for filling and spouting. As compared to an 8" gusset in the prior art, wherein only a 9" gap between in-folds is achieved for a 17" wide bag, the present invention allows for 13" between the in-folds of the gussets. Increasing the spout entry space is a significant advantage over present standard single gussets in large freight shipping bags.

In providing multiple gussets, by having additional folds at the pinch closeable upper and lower corners, there is difficulty in feeding and gathering these numerous thicknesses, which as stated can be 18 ply thicknesses in a three-ply bag with a double gusset. This creates a problem in holding the bag in proper alignment while it is being filled and after letting it go from the filler to move through the folder and sealer. It is important to hold the gussets in position for an even sealing. Accordingly, the invention includes the aforementioned gusset bonding or tacking at least at the upper open end of the bag in order to hold the gusset in control and to strengthen the bag after it is filled and stacked on a pallet. Thus, the upper ends of the gussets are held together for evenly placing the bag into the sealer after bag filling. This maintains the bag in proper registry so that as it is going through the pinch closure sealer, not only is the gusset prevented from coming open at the top, it also does not allow the gusset to "belly down." The upper gusset bonding also provides for a straighter feed into the sealing line and creates a cleaner fold at the pinch closeable fold line. Upper gusset bonding also allows the bag to shape up properly as it is filled and does not let the gussets wander or crimp and become uneven to be sealed in an uneven position.

The gusset tacking is also preferably included at both ends of the bag just beyond the fold line. The tacking thereby offers strength also at the bottom manufactured end as the product is charged into the bag to forcefully impact the bottom of a bag. The gusset bonding increases strength and holds the gusset securely together as they are being shaped and pushed outwardly from the bottom to the top.

The added strength achieved by gusset bonding prevents the ends of the bag from being pushed out at any of the four corners as the bag is going through typical bag flatteners and conventional palletizing systems, and then placed upon a pallet.

The unique stepping pattern at both ends of the bag requires that each ply and its adjacent ply are spaced at a minimum of about 1/16–⅛th inch measured longitudinally. This full stepping avoids product sifting or channeling through the plies by providing for at least the same overlap as in conventional pinch bottom bags, but using less paper by stepping more. This configuration also eliminates the need for mitered inside corners required to open the bag up for filling, which is used in prior art configurations.

In the disclosed preferred embodiment, the multiple gusset bag has double gussets. However, three or more gussets, i.e., each a v-shaped pair of walls, can be provided. The number is mainly limited to the extent that all the thicknesses of the multi-paper plies must be accommodated in bag tubing, forming and, ultimately, bag folding and sealing machinery.

DETAILED DESCRIPTION OF THE INVENTION

Figure 1:
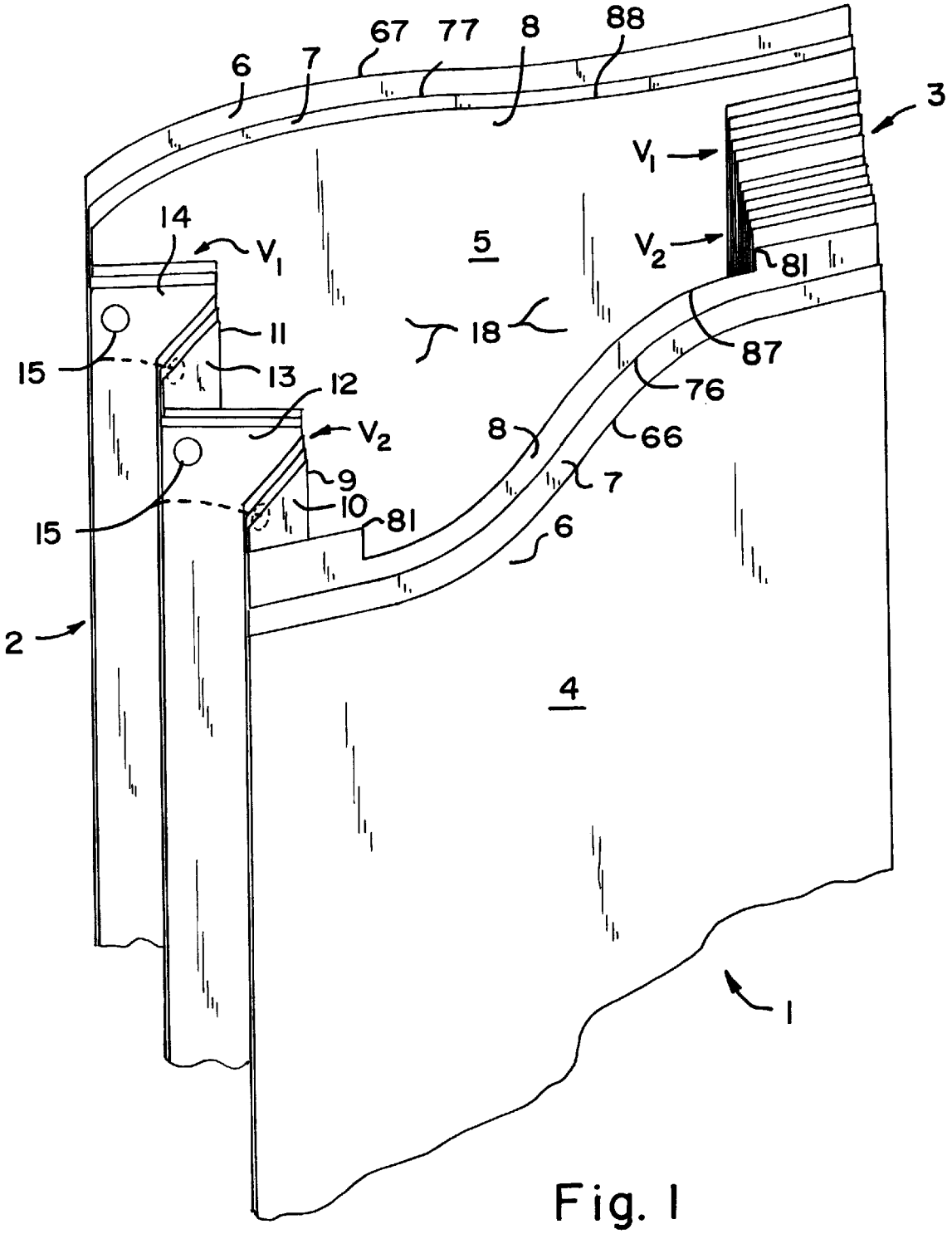
FIG. 1 is a perspective view looking downwardly at the open end of a multi-gusset pinch closeable bag made in accordance with the invention wherein at the right side of the bag the gussets are shown bonded together at their top ends and at the left side are separated to show the locations of the gusset bonding for securing the gussets together.

In the following discussion of FIGS. 1–7, like reference numerals are used throughout to denote the same elements.

As explained above, the invention is directed toward multi-wall pinch closeable freight shipping bags. In the embodiment illustrated, the bag is constructed of three paper plies as shown in FIG. 1, however, two-ply and four-ply bags are also commonly used in the industry and are adaptable to the present invention. The invention is not limited to two-four multiple plies and more plies may be provided depending upon the ply thicknesses chosen and machinery capabilities for handling increased thickness. In that regard, the present invention is directed toward using paper plies made of natural Kraft paper in the range of from about 40 lbs. to 70 lbs. This industry-wide standard refers to the number of pounds per a 3,000 square foot ream of paper. The invention is not limited to natural Kraft paper and other suitable paper materials, or useable alternatives, such as metal foils, polyethylene/paper laminate combinations, other foil/plastic/paper laminates, and plastic extrusions, are all within the penumbra of the invention.

In greater detailed reference to FIG. 1, a three ply multi-wall paper bag 1 is shown in a perspective view. The bag 1 is made up of one 40 lb. natural Kraft paper ply and two 55 lb. Kraft paper plies as will be described below. The bag 1 of the disclosed embodiment has a width of 17", a length of 33", and depth, upon fully expanding side gussets 2 and 3, of about 8". The bag 1 has a front wall 4 and a back wall 5. The front wall 4 and back wall 5 will be seen to be comprised of front and back expanses of bag plies 6, 7 and 8, wherein the bag ply 6 is an outer ply which typically receives printed indicia and may be coated, the ply 7 is an intermediate or middle ply, and the ply 8 is an innermost ply, which would have contact with any product filling the bag 1.

In the preferred embodiment shown, the intermediate ply 7 and inner ply 8 are comprised of 55 lb. Kraft paper plies and the outer ply 6 comprises the 40 lb. Kraft paper. Depending upon the properties of the product to fill the bag, such as product density, physical configurations of granulated or crystalline materials, the bag 1 in the embodiment shown, could be made of three plies of 40 lb. weight each up to three plies of 70 lb. weight. For a two ply construction, the preferred embodiment would utilize two 70 lb. plies to provide sufficient rigidity and strength for most products. However, two plies of 40 lb. each could be used depending on the nature of the material to be filled.

Figure 6:
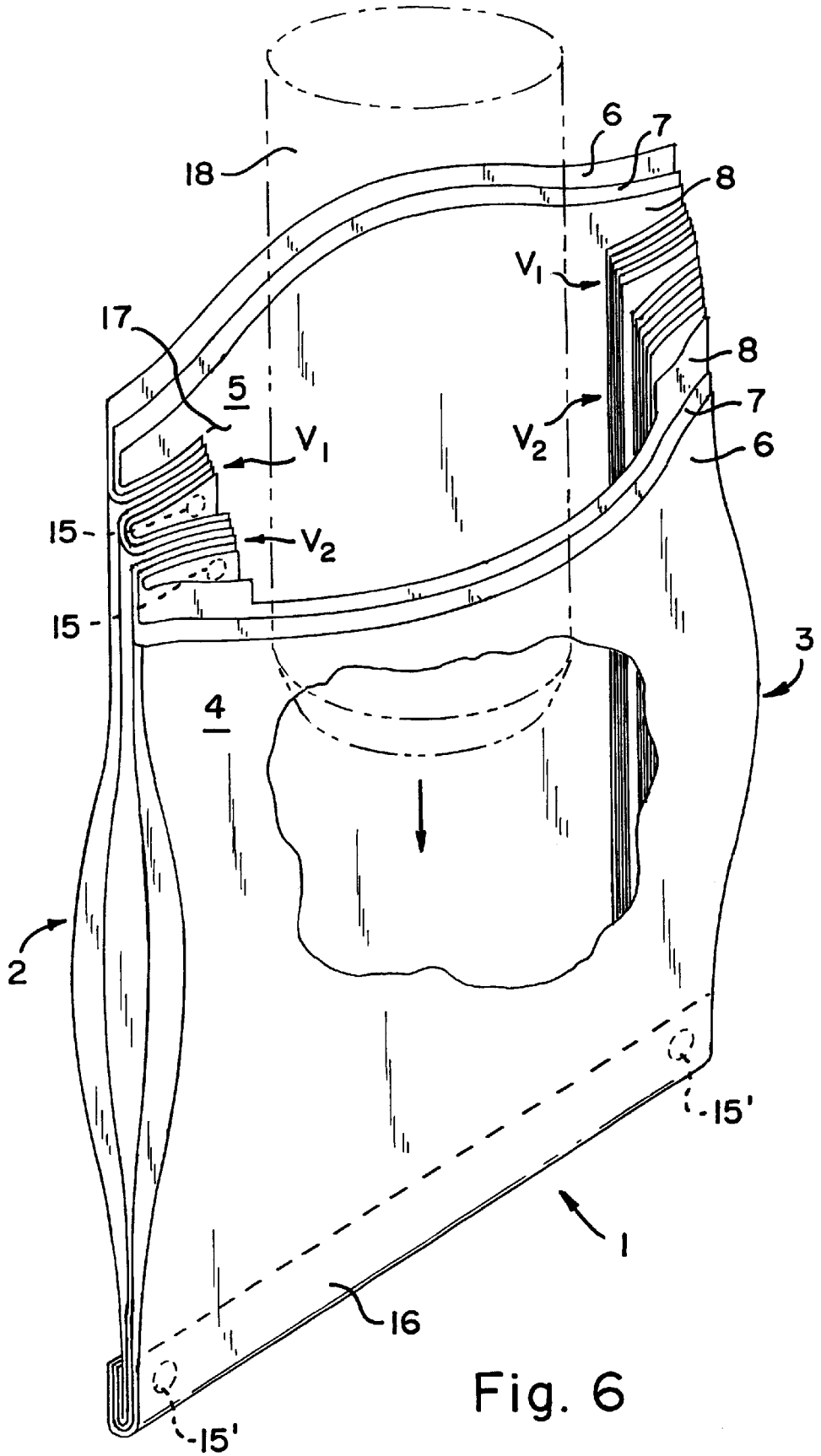
FIG. 6 is a perspective view of the bag as in FIG. 1 wherein a bag filling spout is shown inserted between the bonded ends of the folded gussets and wherein the upper gusset bonding maintains the gussets in place at the upper corners but allows the gussets to expand therebelow upon introduction of the product through the fill spout.
Figure 7:
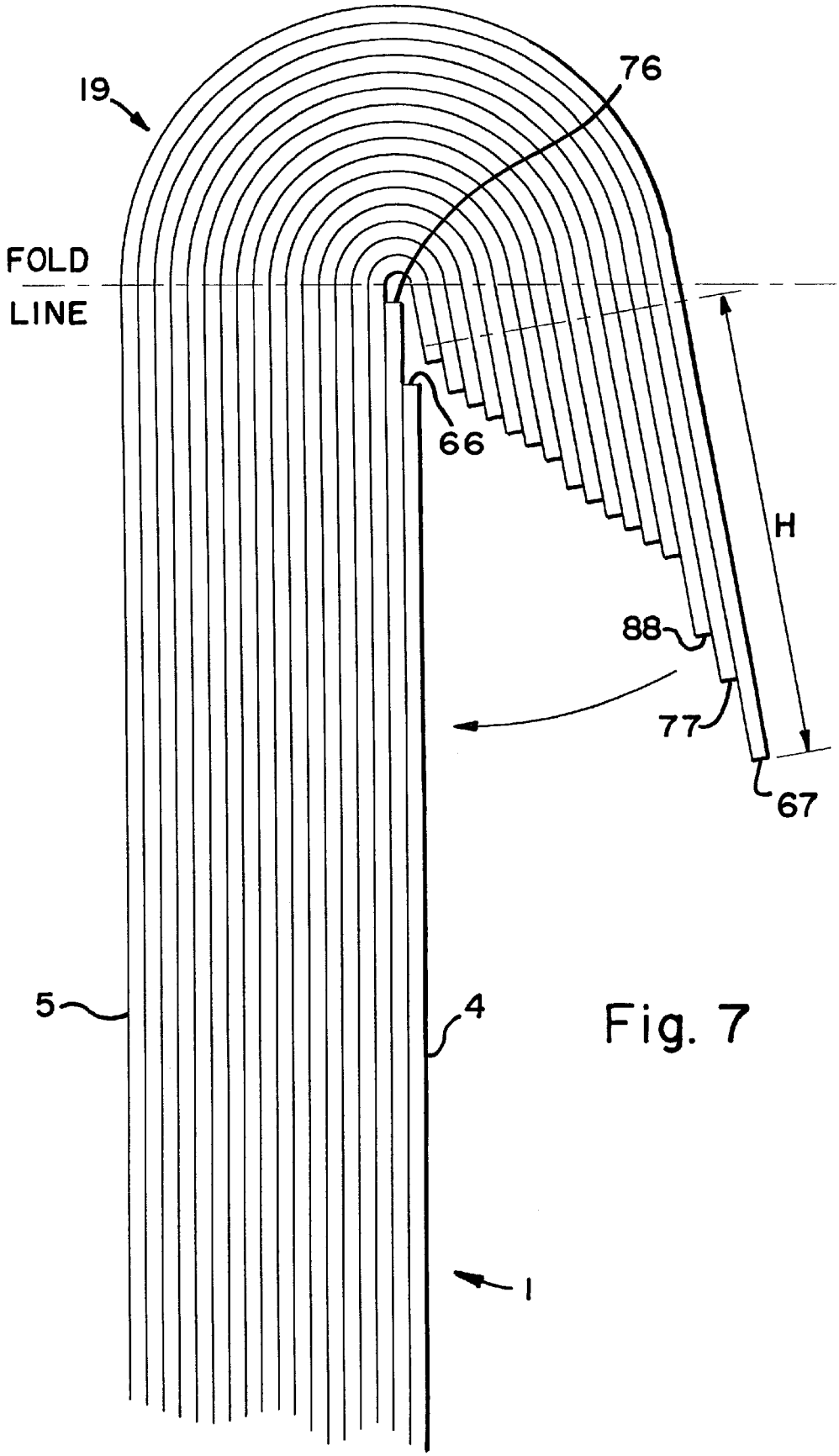
FIG. 7 is a vertical sectional view showing the folding over pinch closure of the bag following the filling step in FIG. 6, whereby the bag is illustrated being folded along the fold line as denoted in FIG. 2 to ultimately effectuate a pinch closure and the overlapping of the multiple ply thicknesses at the side gussets, which are doubled over on themselves at closure.

In all embodiments of the invention, it is envisioned that the side gussets 2 and 3 have at least two gussets, or v-shaped infolds. However, depending upon ply thicknesses and the ability of tube forming and handling equipment to handle increased thicknesses, a larger number of gussets are envisioned within the scope of the invention. In the disclosed embodiment for the bag 1, the side gussets 2 and 3 have substantially identical constructions and like reference numerals will be used for both of their corresponding constituent elements hereinafter. A description of one of the side gussets is therefore applicable to the other. As shown in FIG. 1 the side gusset 2 is shown unfolded for purposes of explanation and includes two v-shape folds $V_1$, $V_2$ having infold edges 9 and 11, respectively, formed at the apices of the gusset walls 10, 12, and 13, 14, respectively. It is envisioned that the depth of the v-shapes $V_1$, $V_2$ will be from about 2" for smaller bags up to about 4" for larger width bags. At the right side of FIG. 1. the side gusset 3 is shown in the flattened prefilled condition ready to expand between ends of the bag as shown in FIG. 6 to ultimately provide a filled-bag width of 8". Because the bag 1 has an overall width of 17", it will therefore be seen that the distance between opposing apices 9 and 11 at opposite side gussets 2 and 3 of the bag creates a spacing of 13" therebetween for receipt of a fill spout therein.

Figure 2:
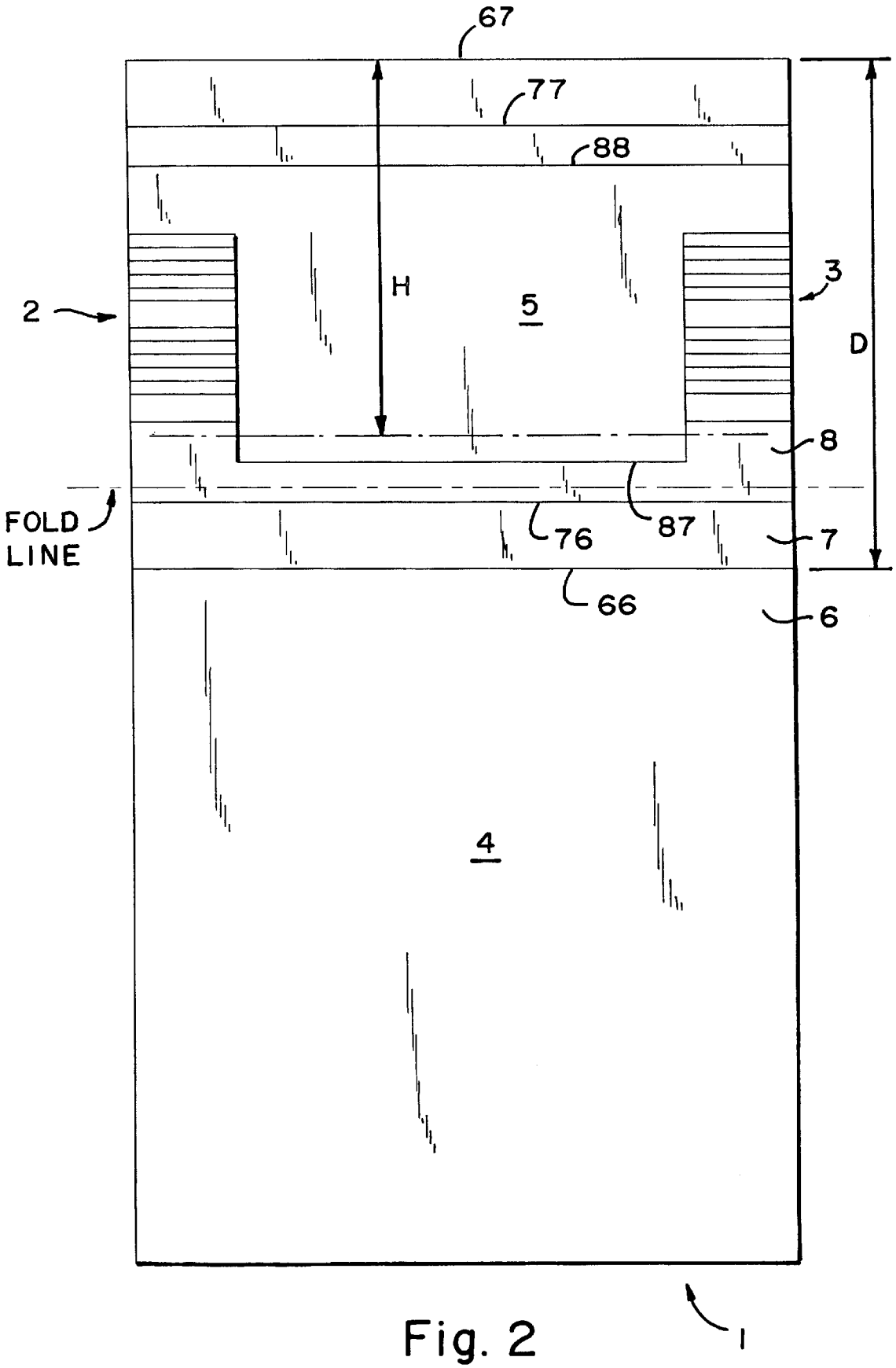
FIG. 2 is a front elevational view of the bag as in FIG. 1 showing the stepping pattern of the front and back bag walls and across the left and right multiple gussets.

In FIG. 2, the side gussets 2 and 3 are shown in a front elevational view in a flattened manufactured stage. The bag 1 is constructed of fully stepped paper plies 6, 7 and 8, which create the ladder-like appearance at the folded upper portions of side gussets 2 and 3 in FIG. 2. The ends of the side gussets 2 and 3 at both the upper and lower ends of the bag 1 are maintained in the flattened condition, as shown for gusset 3 at the right side of FIG. 1, by means of gusset bonding or tacking at spot adhesive points 15 best shown in FIG. 1 at the expanded left side gusset 2. The adhesive tack points 15 bond the walls 10 and 12 together and 13 and 14 together at v-shapes $V_1$ and $V_2$, respectively, whereby the side gussets 2 and 3 are clamped together at these bag end locations. The side gusset 2 in FIG. 1 is expanded (untacked) for illustrative purposes, but would otherwise be maintained as shown for the right side gusset 3 during filling.

The adhesive envisioned for the adhesive tacking at points 15 is a starch based glue, which is applied as the bag tube is formed and folded to create the side gussets 2 and 3 and is longitudinally seamed in a well known bag tube making process as would be understood by those in the art. The tacking points 15 between the gusset walls are shown as single dots, but multiple tack points are optional.

Upon filling the bag, the upper ends of the side gussets 2 and 3 would be folded over along the fold line indicated in FIG. 2 to create a pinch closure at the top of the bag 1. The invention is therefore characterized by the adhesive tacking at points 14 at the upper ends of the side gussets 2 and 3 and also by the unique stepped arrangement of the plies 6, 7 and 8 as will be further understood in connection with FIGS. 3–5.

Figure 3:
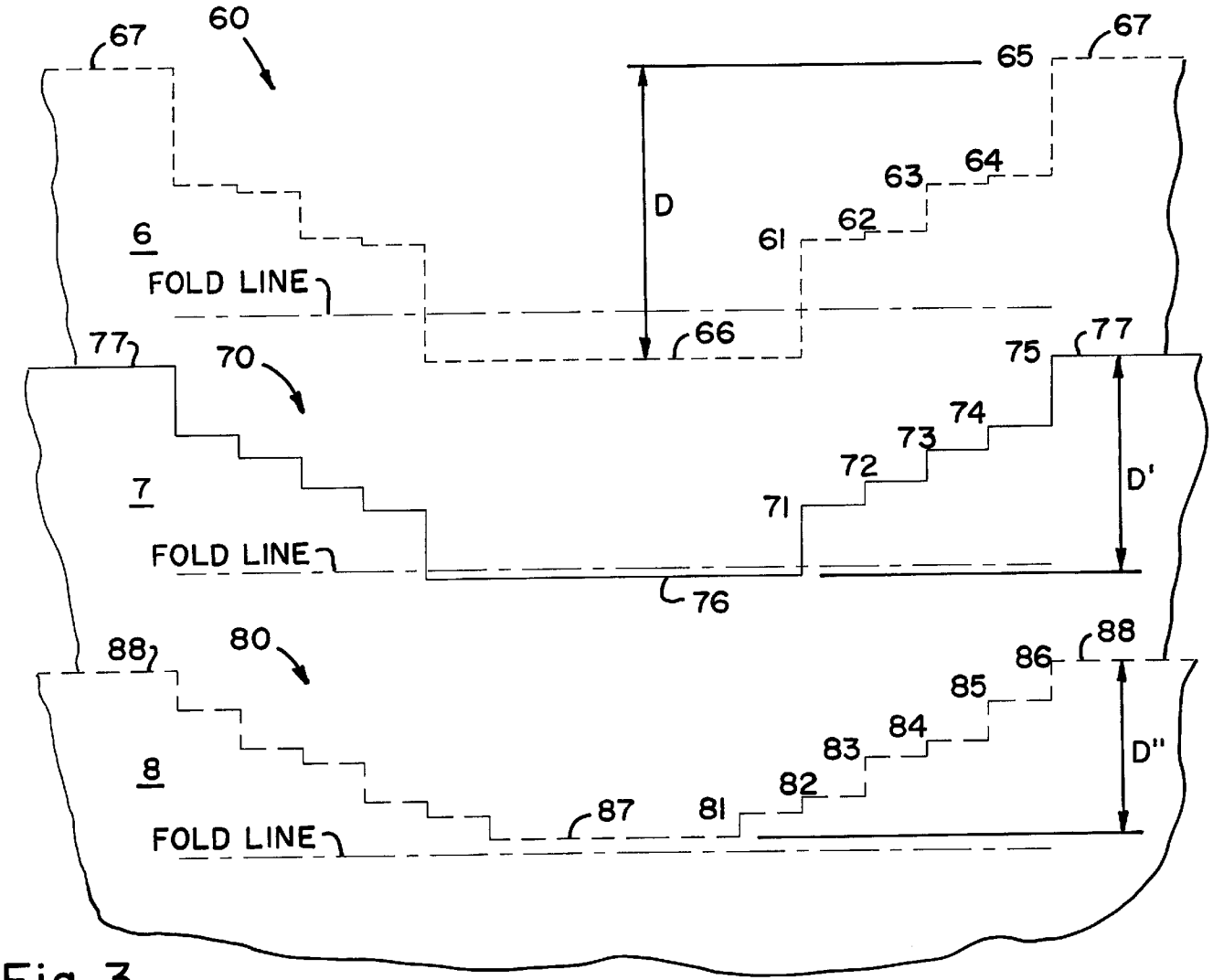
FIG. 3 illustrates the knife bar cutting configurations used to provide a three ply double gusset stepping pattern having a longitudinal span of about 2⅜", and further showing the location of the fold line relative to the knife cuts at each of the plies.

With reference to FIG. 3, three knife bar ply cuts are schematically shown at reference numerals 60, 70 and 80 which, respectively, are the cuts made for stepping the plies 6, 7 and 8 shown in FIGS. 1 and 2. The ply fold lines for each of the knife bar cuts are indicated, which correspond to the common fold line shown in FIG. 2 whereby the stepped plies are overlain and registered along match lines by tubing and forming equipment for the production of the bag 1. It will be seen that the knife bar cut 60 drawn in small dashed lines creates five steps 61–65, as noted. The knife bar cut 60 is also known as the print ply knife cut because it is used to cut the outer ply 6 which may include a printable surface for advertising and labeling indicia. The central lowest edge, labeled 66, up to the highest edge 67 represents the maximum longitudinal step distance labeled D. For a conventional bag having a width in the range of from 14–17", this distance D would normally be, for a single gusset bag, 2¼" or less. In the preferred embodiment of the invention, the dimension D is 2⅜" and may be from about 2¼" to about 2½" providing an increase of up to about 15% in length for the stepping pattern. In the disclosed embodiment the first step 61 provides a step up of 5/16ths; step 62 steps up 1/16th inch; step 63 steps up 3/8ths inches; step 64 steps up 1/16th inch; and, step 65 steps up 15/16 inches to reach the upper edge 67 as labeled in FIG. 1. Accordingly, the lowest edge 66 is the lowest stepped edge portion of the ply 6 and extras across the front wall 4. This is also illustrated in the front elevational view in FIG. 2.

The middle ply 7, having knife bar cut 70 is shown in the center of FIG. 3 and is distinguished from the cutting line of knife bar 60 in that it is shown in solid lines wherein the cut line for the knife bar 60 is shown in said small dashed lines. Like knife bar cut 60, knife bar cut 70 provides five steps up numbered 71-75 as noted. They rise from the lowest edge 76 to the upper edge 77. For the knife bar cut 70, the distance D' between the lowest edge 76 to the upper edge 77 is 1¾". The upper and lower edges 76 and 77 are also referenced in FIGS. 1 and 2. The steps 71–77 provide incremental rises therebetween to form the stepping pattern for the middle ply 70, wherein step 71 steps up from edge 76 a distance of 9/16ths inches; step 72 steps up 3/16ths inches; step 73 steps up ¼ inch; step 74 steps up 3/16th inches; and, step 75 steps up 9/16th inches to the upper edge 77.

The knife bar cut 80 is the inside ply knife cut for the inner ply 8 and is shown in long dashed lines. The inner ply 8 is cut to have six steps up 81–86 as illustrated. These steps up rise a distance D" which is 1⅜" from a lowest edge 87 up to an upper edge 88, as shown and also as noted in FIGS. 1 and 2, which are the respective front and back edges of the ply 8 extending between the side gussets 2 and 3. Accordingly, the inner ply 8 has an additional step provided which is needed to achieve the first inward steps 81, as shown in FIG. 1. The knife bar cut 80 creates six steps up labeled 81–86, wherein step 81 provides a step up of 3/16ths inches; step 82 steps up 1/8th inch; step 83 steps up 5/16ths inches; step 84 steps up 1/8th inch; step 85 steps up 5/16th inches; and, step 86 steps us 5/16th inches to the upper edge 88 as shown.

With respect to the location of the fold line relative to the knife bar cuts 60, 70 and 80, it will be seen that the edges 66 and 76 are below the fold line and accordingly would not be folded to make a pinch closure, but the edge 87 is shown to be above the fold line for the inner ply 8. Accordingly, the edge 87 is folded over for a small overlap dimension which in the preferred embodiment is about 1/16th inch, as will be further discussed in connection with FIG. 7.

Figure 4:
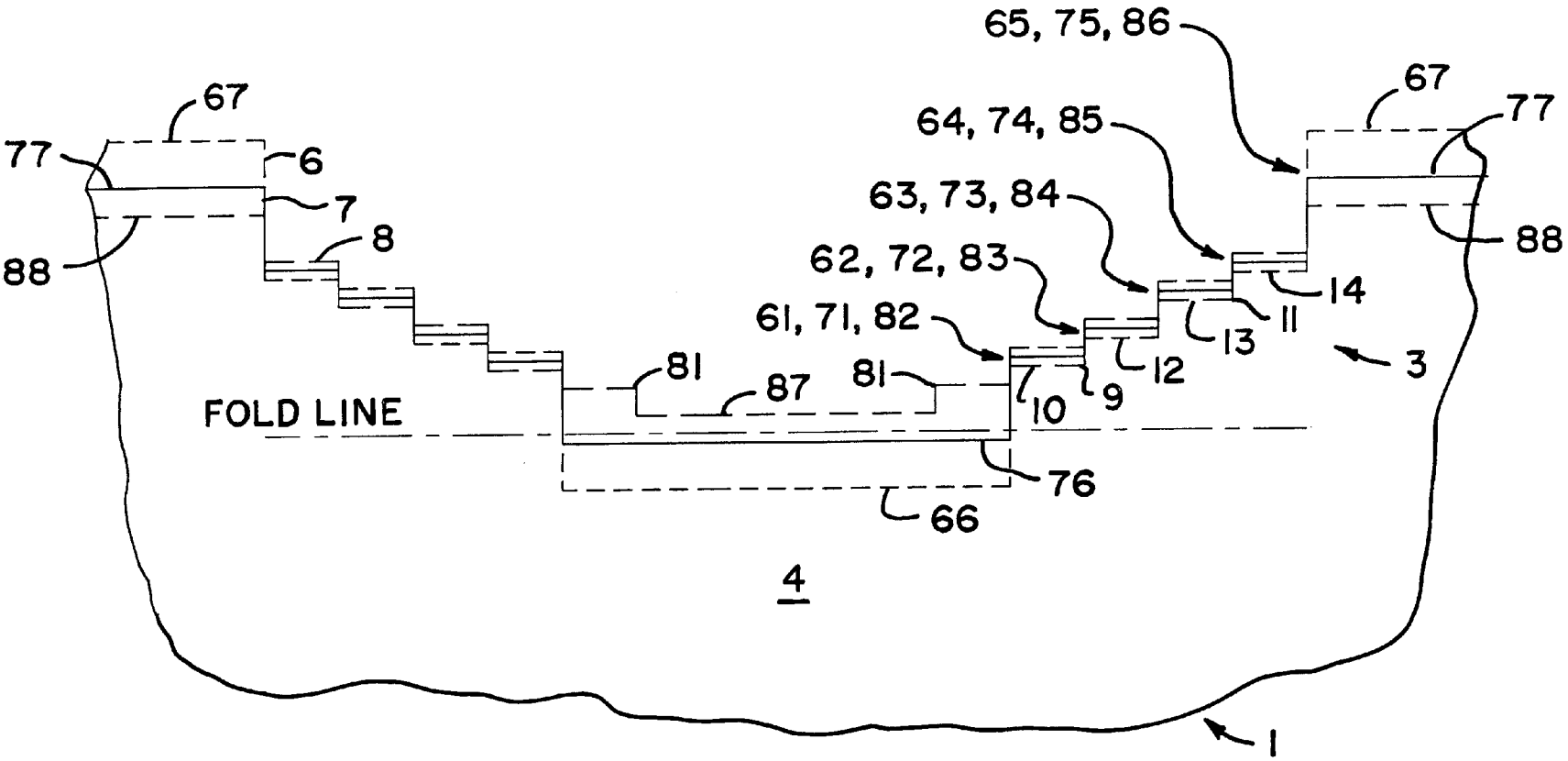
FIG. 4 schematically illustrates the three ply knife cuts of FIG. 3 superimposed to form the bag and showing how each ply is stepped or shingled individually throughout the gussets and the relation of the ply cut upper stepped edges.

In FIG. 4, the knife bar cuts 60, 70 and 80 for the plies 6, 7 and 8 are shown schematically superimposed for purposes of illustration. It will be understood that the plies 6, 7 and 8 extend to the left and to the right of the front wall 4, shown in FIG. 4, and would be joined by the tuber to form the back wall 5, shown in FIG. 1 as would be clear to one skilled in the art. The seaming lines for the tube forming of the plies 6, 7 and 8 would be laterally offset as in a typical tubular bag construction and are not illustrated, but would be understood by those in the bag making art.

The knife bar cuts 60, 70 and 80 of FIG. 3 are superimposed in FIG. 4 in the assembled vertical relation to each other during manufacturing just before the gusset infold v-shapes $V_1$, $V_2$ for side gussets 2 and 3 are made. FIG. 4 is a schematic illustration wherein the solid line of middle ply 7, and the dashed lines for plies 6 and 8, are not intended to shown phantom or hidden lines, but instead to illustrate the stepped relationships of the edges of the plies (61–67; 71–77; 81–88), as they are stepped upwardly from the lower edges 66, 76 and 87 up through the stepping to the upper edges 67, 77 and 88, respectively.

Each of the steps shown in FIG. 3 for the plies 6, 7 and 8 are labeled in FIG. 4. They are cut to equal lateral widths between corresponding stepped edges, and wherein the inner ply 8 has the inward most first steps 81, and the plies are stepped sequentially upward therefrom at the overlying triple sets of steps up 61, 71 and 82; 62, 72 and 83; 63, 73 and 84; 64, 74 and 85; and 65, 75 and 86. In this regard it will be seen that side gusset 3, as well as side gusset 2, is formed by the folding of their respective walls 10, 12 at apex 9, and walls 13, 14 at apex 11, after the knife cut steppings up are aligned and registered.

With reference to FIGS. 2 and 4. it will be seen that the steps of the plies 6, 7 and 8 at walls 10, 12, 13 and 14 have smaller incremental steps up between adjacent ply edges than do the front wall 4 between the gussets and the back wall 5 of the bag 1. In the preferred embodiment, the overall stepping distance D, as noted in regard to FIG. 3, is 2⅜ths inches, wherein the steps of the ply edges forming the gusset walls 10, 12, 13 and 14 are the smallest and in the range of from about 1/16th–1/8th inch between adjacent sequential ply edges. Whereas, the stepping distances between the ply edges 88, 77 and 67 and 66, 76 and 87 are larger and in the range of from about 3/16th–5/16th inches between adjacent sequential ply edges of the stepped bag walls.

Figure 5:
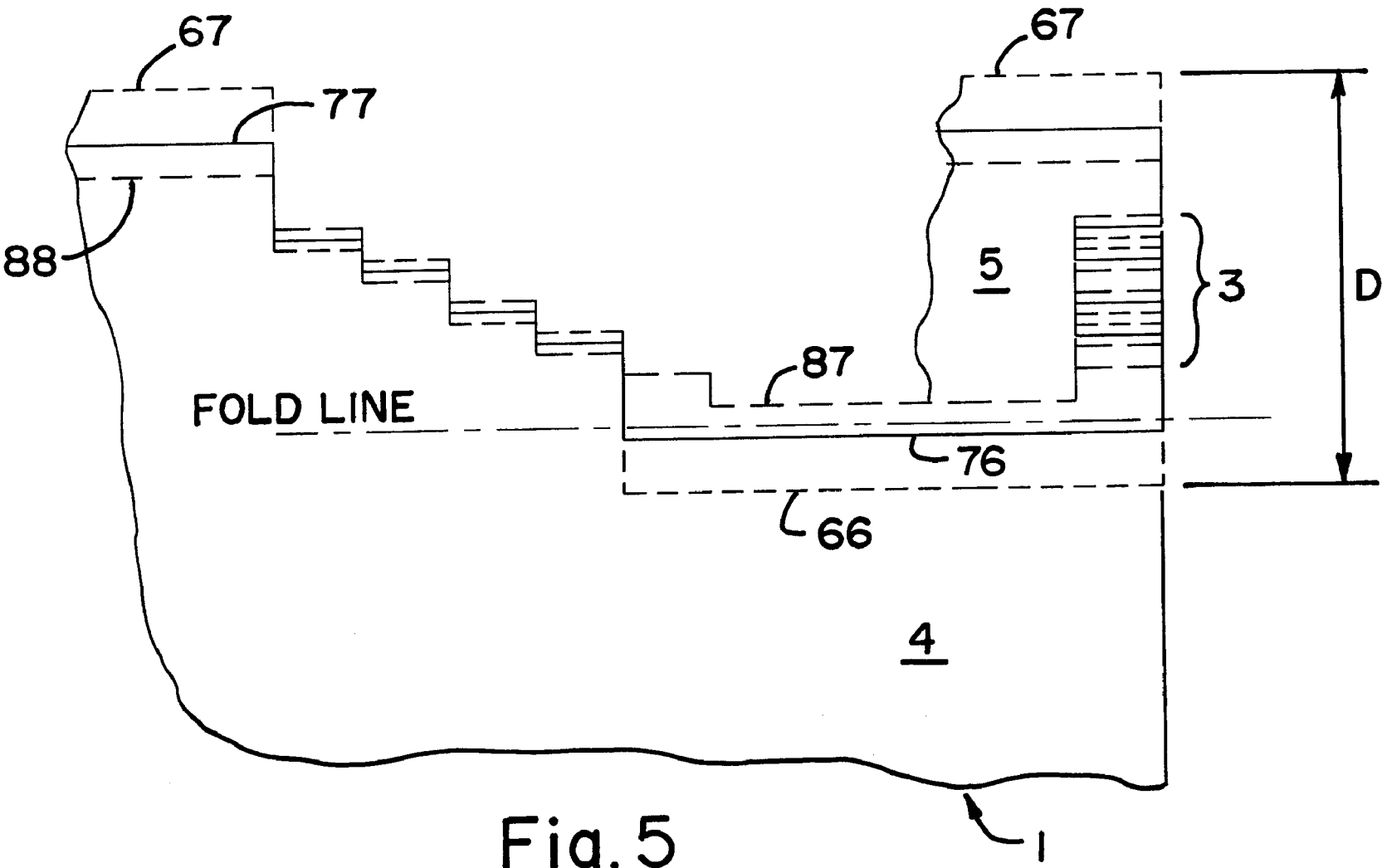
FIG. 5 is similar to FIG. 4 but, wherein at right side of the bag, the bag is shown in the completed gusset-folded arrangement, wherein the three paper plies are folded together to create 18 thicknesses and stepped at the double gusseted sides of the bag.

FIG. 5 is another schematic illustration which shows at the left half thereof the same schematic relationship of the stepped bag plies as in FIG. 4, but wherein the right half illustrates the relationship of the bag edges when the side gusset 3 is formed by folding the bag (a) at the "V" apices 9 and 11, and (b) between the gusset walls 10 and bag front wall 4, and (c) between the gusset walls 14 and bag back wall 5. The dimension D is denoted for the 2⅜th inch stepping length between the front wall lowest edge 66 and back wall upper edge 67 of the outer ply 6.

With reference to FIG. 6, a fully formed bag I is shown wherein the bottom end, which is the so called "manufactured end" is denoted at reference numeral 16, has a pinch closure made across the bag bottom and the opposite open upper bag end denoted at reference numeral 17 receives a filling spout 18. The adhesive tacking locations 15 shown in FIG. 1 at the upper ends of the gussets 2 and 3 have counterparts 15' at the lower ends, noted in dashed lines, for purposes of holding the gussets 2 and 3 together at the bottom of the bag for strength and allowing the side gussets 2 and 3 therebetween to "square out" to fully fill the bag 1 between the bottom pinch closure 16 and upper open end 17. The V-shapes $V_1$ and $V_2$ are thus clamped tightly and tacked together at the upper tacking locations 15, wherein the front wall 4 and back wall 5 are allowed to flare open from the gusset walls 10, 14, respectively, in order to have product fill the bag 1 entering through the spout 18 as indicated by the arrow.

The dimensions of the bag I for the disclosed embodiment as noted above are 17" wide by 33" long and wherein the side gussets 2 and 3 expand to create a bag depth or side of 8". This is one standard bag dimension and other common sizes are 15" by 31¾" by 7"; 15½" by 31" by 7"; 15" by 30" by 7¾"; 14¾" by 31" by 7". However, it is envisioned that variously-sized freight shipping bags can be employed for the present invention and having a wide range of dimensions, such as a width from about 12" to about 24" and a length from about 18" to about 36". In this regard the gusset dimension may range from about 5½" up to 12" deep from the front wall 4 to the back wall 5. Typically, smaller bags would not be used for heavy weight commodity materials used in industry, wherein freight shipping bags are typically large sized and offer strength and tear resistance, versus a popcorn, vacuum cleaner or coffee bag, where filling dynamics and weights are not remotely as demanding. In the disclosed embodiment, the fill spout 18 has a space to fit between the V-shapes $V_1$ and $V_2$ of about 13", since the V-shapes extend 2" bag inwardly at each side of the 17" wide bag. It is envisioned that the disclosed ranges for freight shipping bag dimensions are those that would be typically useful for the application of the present invention, wherein the V-shapes would extend inwardly from the bag sides a dimension in the range of from about 2" to about 4", which range would facilitate an efficient filling out of the bag when charged with a product. Efficiently and non-tearingly filling out gussets that extend bag inwardly greater than about 4" is not impossible, but creates weakened points subject to rupture. As noted above, a minimum gusset depth of about 5½" front wall-to-back wall is envisioned as a practical minimum. Gussets less than that would not have the criticality for filling out and strength because of the smaller dimension. While the invention can be used for smaller depth gussets, there is greater application for gusset depths of greater than 5½" to fulfill the industry's needs for large gussetted bags.

Other practical limitations involve the thicknesses that bag tubing and forming equipment can handle. It will be appreciated in connection with the cross sectional view of FIG. 7 that when the stepped gussets of a double gusseted bag, as for the bag 1 disclosed, are formed there results 18 thicknesses through the side gussets 2 and 3. This is because the three plies are double folded at the V-shapes creating six walls, each having three plies (6, 7 and 8). Then, when folded over around the fold line to complete the pinch closure noted at reference numeral 19 at the upper end 18 of the bag 1 shown in FIG. 7, the number of thicknesses to be sealed closed would have 34 ply (18+16) thicknesses. This is because the bottom edges 66 and 76 are not folded over. Thus leaving two less thicknesses to be overlapped. When using 40–70 lb. natural Kraft paper, the bag forming and sealing equipment must be able to handle these thick overlaps. To facilitate the sealing of the bag to close the upper end 18 and form the pinch closure 19, similar to pinch closure 16, the stepped plies are coated during the bag making process with a hot melt adhesive which is heat activated to seal the pinch closure 19. The hot melt adhesive is provided across the face of these stepped portions of the bag 1 in a region having a length H (see FIGS. 2 and 7) from the edges 67, 77, 88 downwardly to slightly above the inner ply edge 86, which dimension H in the preferred embodiment is approximately 1¾" long and fully across the face of the bag, across the side gusset 2, the back wall 5, and the side gusset 3. Thus, the bag 1 when filled is fed to bag sealing equipment wherein the adhesive bonding locations 15 maintain the upper ends of the side gussets 2 and 3 together thereat, which keeps the bag in shape for (a) an even feeding into standard pinch closure sealing equipment, (b) holding the bag in even alignment with the equipment to facilitate even folding around the fold line 19, (c) activating the hot melt adhesive, and (d) pinching close the bag to complete a bag closure in a similar final condition to the manufactured pinched closed end 16 illustrated in FIG. 6.

Figure 8:
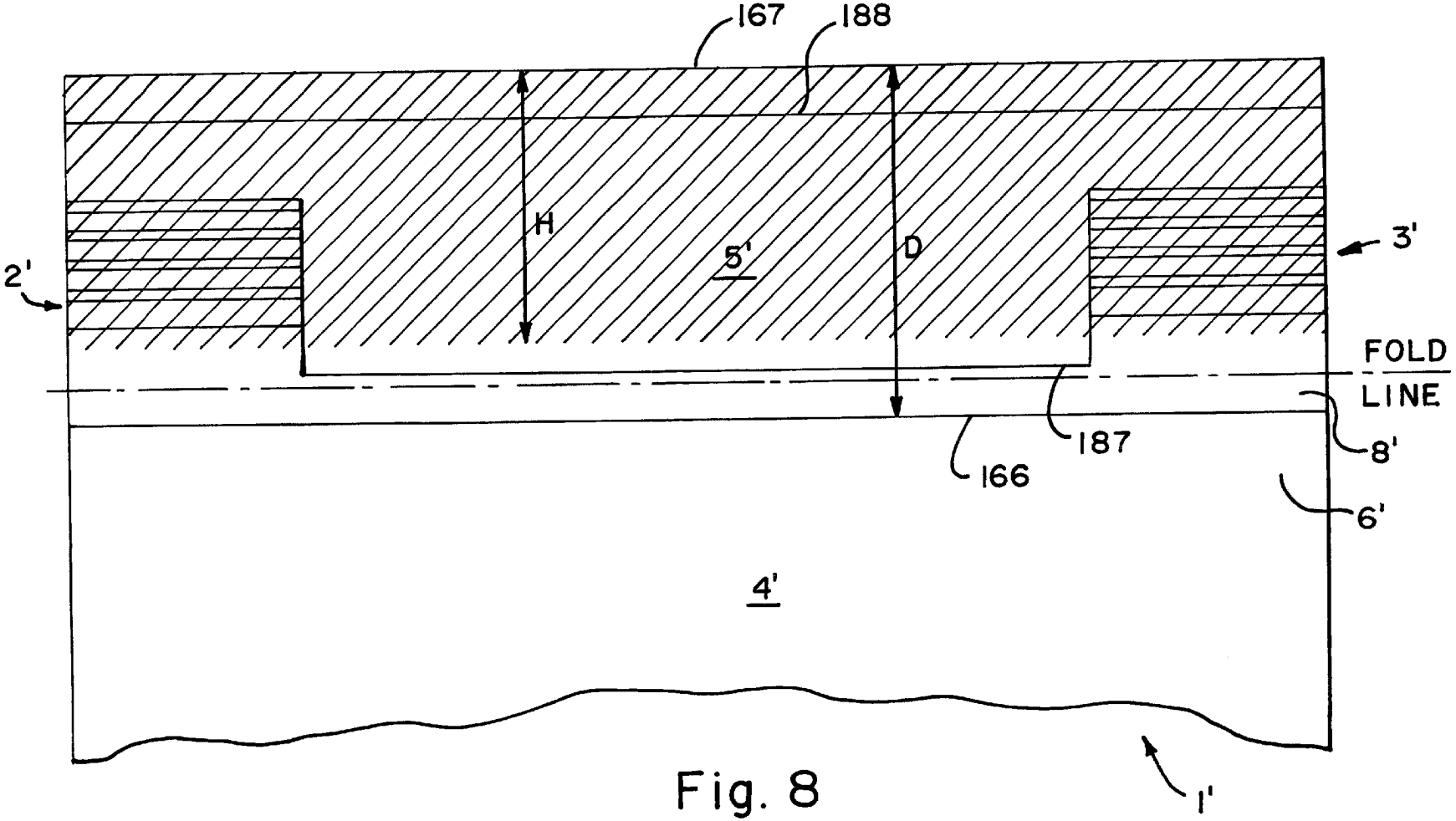
FIG. 8 is a front elevational view of the bag similar to FIG. 2 but showing an alternate embodiment having a two-ply bag.
Figure 9:
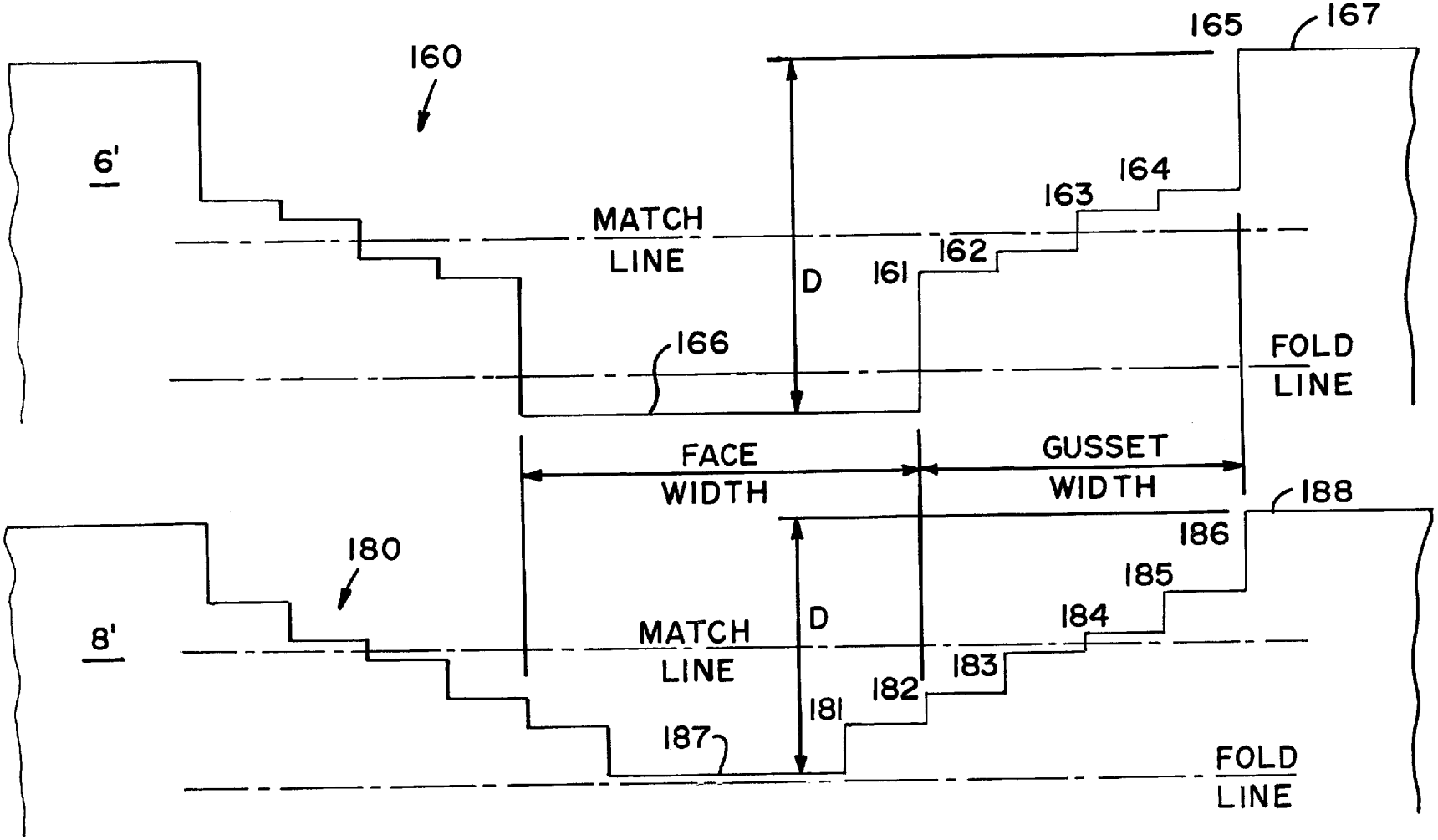
FIG. 9 illustrates the knife bar cutting configurations used to provide a two-ply double gusset stepping pattern having a longitudinal span of about 2¼", and further showing the location of the fold line relative to the knife cuts at each of the plies similar to FIG. 3.

It will be appreciated that the bag 1 can be made in a second preferred embodiment having two plies. Reference is now made to FIGS. 8 and 9 wherein a two-ply bag construction is shown having an outer print ply 6' and an inner ply 8' for a bag 1'. For the two-ply construction a somewhat different knife bar cutting arrangement is utilized. In regard to FIG. 9, knife bar cuts 160 are shown for the outer print ply 6' having five steps up 161–165 which rise a distance D from a lowest front edge 166 up to an upper back wall edge 167. The distance D in this embodiment for a bag having the length and width dimensions as set out for bag 1 is 2¼.

The inside ply 8' is formed by knife bar cuts 180 having six steps up shown at steps up 181–186. The stepping cuts for the ply 8' extend upwardly from a lowest front wall edge 187 up to an upper back wall edge 188 a distance D" of 1⅝".

In FIG. 9, a match line is provided to show the distance above and below where the knife bar cuts 161–165 and 181–186 are made. The match line is the line over which the plies are to be superimposed for bag forming. Also in FIG. 9, the fold line, as in FIGS. 2–4, is shown. In FIG. 8, the plies 6' and 8' are overlain in a schematic arrangement to show the relative positions of the steps and wherein the fold line is shown slightly below the edge 187 and above the edge 166, whereby the edge 166 is not folded over.

Similar to the bag 1, a band or zone of hot melt adhesive H extends for about 1¾" downwardly from the upper most bag edge 167 of the print ply 6' down toward, but stopping short of, the lowermost edge 187 of the inside ply 8'.

To the left and right of FIG. 8, the corresponding gussets 2' and 3' are made similar to the gussets 2 and 3. Similar to the bag 1, the bag 1' is stepped whereby the smaller incremental steps of sequentially vertically adjacent edges are made through the gussets 2' and 3' and a greater stepping of vertical incremental distances are made between the front and back wall edges that do not make up part of the gussets. In the disclosed embodiment for the bag 1', two v-shape folds are made at either side to form the gussets 2' and 3' similar to v-shapes $V_1$ and $V_2$ of FIG. 1. Thereby, the alternate preferred embodiment in FIGS. 8 and 9 is also a double gusset bag. As noted above, the bag 1' is disclosed as having two 70 lb. Kraft paper plies for the plies 6' and 8', but for lighterweight materials having less stress creating dynamics, two 40 lb. paper plies might be used.

At the gussets 2' and 3' there would be 12 ply thicknesses and upon folding the upper open end of the bag for a pinch closure, the bag would have a maximum of 23-ply thicknesses, since the lowest edge 166 of the print ply 6' is not folded upon itself.

The knife bar cuts 160 of the print ply 6' provide that the step up 161 is ⅞"; the step up 162 steps up ⅛"; the step up 163 steps up ¼"; the step up 164 steps up ⅛"; and, the step up 165 steps up ⅞". For the knife bar cuts 180 of the inside ply 8', from the lowest edge 187 the step up 181 steps up ⅝"; the step up 182 steps up 3/16"; the step up 183 steps up ¼"; the step up 184 steps up ⅛"; the step up 185 steps up ¼"; and, the step up 186 steps up ½".

The filling and pinch closure of the bag 1' is substantially identical to the bag 1 except for the reduction by one-ply thickness, which thinner profile is more easily accommodated in bag handling, filling and sealing equipment. The gussets 2' and 3' are similarly provided with bonding locations substantially identical to the bonding locations 15 and 15' of bag 1.

Greater than three ply construction is also envisioned, for example, a four ply multi-gusseted bag may be provided in accord with the invention and formed of, for example, three 40 lb. Kraft paper plies and one 55 lb. Kraft paper ply. The gusset ply thicknesses would then have 24 plies at the gussets and, when folded over to create a pinch closure, would have greater than 40 thicknesses to be hot melt adhesively sealed. The invention can be practiced with these increased thicknesses, but depends upon the capacity of tubing, forming, handling, sealing and filling equipment, and their ability to accommodate these multiple plies.

The foregoing is a description of preferred and alternate embodiments of the invention, but the claims appended hereto are not limited thereby, and encompass a broader scope.

What is claimed is:

1. A gussetted multi-wall bag comprising a tubular multi-wall bag having upper and lower ends, said upper and lower ends being pinch closeable;

front and back walls joined at opposite bag sides by at least two side gussets running the length of the bag;

said at least two side gussets having upper and lower ends adjacent the upper and lower ends of said bag;

said at least two side gussets each having a generally v-shaped configuration;

said at least two side gussets each having walls joined at an apex forming the v-shape;

said walls of the v-shaped gussets being bonded together at the upper and lower ends thereof, wherein the bonding comprises at least one adhesive bond location therebetween;

said front and back bag walls, and said at least two side gussets having upper and lower ends that are stepped whereas to form ply edges that are stepped with respect to next adjacent ply edges; and said at least two side gussets being non-bonded and freely expandable between said upper and lower bonded ends upon the receipt of product into the bag.

2. The gussetted multi-wall bag as claimed in claim 1 wherein the bag comprises at least two plies.

3. The gussetted multi-wall bag as claimed in claim 1 wherein the v-shape gussets extend inwardly from the side of the bag in the range of from about 2" to about 4".

4. The gussetted multi-wall bag as claimed in claim 1 wherein the at least two side gussets provide about at least 5½" distance between the front and back wall upon being expanded upon product filling within the bag.

5. The gussetted multi-wall bag as claimed in claim 1 wherein the plies comprise paper.

6. The gussetted multi-wall bag as claimed in claim 5 wherein the paper comprises from about 40 lb. to about 70 lb. natural Kraft paper.

7. The gussetted multi-wall bag as claimed in claim 1 wherein the bag has a width in the range of from about 10" to about 24".

8. The gussetted multi-wall bag as claimed in claim 1 wherein the adhesive comprises a starch based adhesive.

9. The gussetted multi-wall bag as claimed in claim 1 wherein the stepping pattern of said multiple plies provides incremental steps between sequential edges of said gusset walls less than the stepping distances between adjacent ply edges at the front and back wall of the bag between said at least two side gussets at each bag side.

10. The gussetted multi-wall bag as claimed in claim 1 wherein a hot melt adhesive extends across at least one end of the bag covering the stepping pattern at said bag end wherein said bag end has a predetermined fold line for forming a pinch closure and wherein the hot melt adhesive extends across the bag in a region between a lowest edge of a bag ply and the upper most edge of the paper plies.

11. A gussetted multi-wall bag having a plurality of paper plies comprising:

from two to four plies being seamed together in a tubular relationship and being longitudinally stepped;

said tubular bag having opposite side edges;

said side edges each being defined by at least two gussets thereat joining front and back walls of said tubular bag;

said tubular bag having at least one open end for receipt of product therein;

said gussets having in-folded walls meeting at apices;

said gusset walls being adhered together at said upper open end of the bag at both side edges thereof; and, said front and back walls of said tubular bag being freely expandable in the region adjacent said bonding of said gusset walls facilitating the introduction of product into the bag through a fill spout means.

12. The multi-wall bag as claimed in claim 11 wherein the bag comprises two paper plies.

13. The multi-wall bag as claimed in claim 12 wherein two paper plies comprise paper in the range of 40–70 lb. natural Kraft paper.

14. The multi-wall bag as claimed in claim 11 wherein said bag comprises three paper plies.

15. The multi-wall bag as claimed in claim 14 wherein said paper plies comprise one ply being constructed of about 40 lb. natural Kraft paper and the other two plies being constructed from greater than about 40 lb. natural Kraft paper.

16. The multi-wall bag as claimed in claim 11 wherein the gussets extend from about 5½" to about 12" between said front and back walls joined therebetween.

17. The multi-wall bag as claimed in claim 11 wherein the gusset walls extend to be joined bag inwardly at a distance from the side of the bag in the range of from about 2" to about 4".

18. A multiple gussetted multi-wall freight shipping bag for filling with a product and having a pinch closed bottom end, an open pinch closeable upper end, and having multi-ply front and back walls joined by multiple side gussets integrally formed with said front and back bag walls, wherein said multiple gussets have gusset walls adhesively bonded together at a location on each adjacent the upper end of said bag and wherein said bag front and back walls being freely expandably associated with gusset walls adjacent said adhesive bonding for expansion upon introduction of product into the bag.

19. A multiple gussetted multi-wall freight shipping bag as in claim 18 wherein said gusset side walls are bonded at both said ends of said bag.

* * * * *